United States Patent [19]

Myklebust et al.

[11] Patent Number: 4,944,604

[45] Date of Patent: Jul. 31, 1990

[54] FLEXIBLE CONTAINER COMPRISING SEVERAL LIFTING MEANS

[75] Inventors: Eirik Myklebust; Odd F. Rasmussen, both of Porsgrunn, Norway

[73] Assignee: Norsk Hydro a.s., Oslo, Norway

[21] Appl. No.: 288,644

[22] PCT Filed: Apr. 18, 1988

[86] PCT No.: PCT/NO88/00028

§ 371 Date: Dec. 21, 1988

§ 102(e) Date: Dec. 21, 1988

[87] PCT Pub. No.: WO88/08400

PCT Pub. Date: Nov. 3, 1988

[30] Foreign Application Priority Data

Apr. 24, 1987 [NO] Norway ..... 871705

[51] Int. Cl.[5] ..... B65D 30/04; B65D 33/02; B65D 33/14

[52] U.S. Cl. ..... 383/7; 383/17; 383/24; 383/67

[58] Field of Search ..... 383/7, 8, 17, 22, 24, 383/93, 71, 72, 67

[56] References Cited

U.S. PATENT DOCUMENTS

| | | | |
|---|---|---|---|
| 3,789,897 | 2/1974 | Saito | 383/24 |
| 4,136,723 | 1/1979 | Skaadel et al. | 383/8 |
| 4,191,229 | 3/1980 | Skaadel et al. | 383/8 |
| 4,221,250 | 9/1980 | Manerla | 383/24 |
| 4,223,709 | 9/1980 | Myklebust | 383/3 |
| 4,269,247 | 5/1981 | Omdal | 383/8 |
| 4,300,608 | 11/1981 | Cuthbertson . | |
| 4,362,199 | 12/1982 | Futerman | 383/17 |
| 4,393,910 | 7/1983 | Rasmussen | 383/8 |
| 4,584,705 | 4/1986 | Myklebust | 383/8 |
| 4,610,028 | 9/1986 | Nattrass | 383/7 |
| 4,703,517 | 10/1987 | Marino | 383/7 |
| 4,736,449 | 4/1988 | Myklebust | 383/8 |
| 4,807,299 | 2/1989 | Nattrass et al. | 383/7 |

FOREIGN PATENT DOCUMENTS

| | | | |
|---|---|---|---|
| 0026287 | 4/1981 | European Pat. Off. | 383/8 |
| 0026288 | 4/1981 | European Pat. Off. | 383/8 |
| 0030652 | 6/1981 | European Pat. Off. | 383/8 |
| 0041586 | 12/1981 | European Pat. Off. | 383/7 |
| 0047389 | 3/1982 | European Pat. Off. | 383/8 |
| 1475019 | 6/1977 | United Kingdom . | |
| 1549448 | 8/1979 | United Kingdom . | |
| 2092990 | 8/1982 | United Kingdom | 383/7 |
| 2116143 | 9/1983 | United Kingdom | 383/17 |

*Primary Examiner*—Stephen Marcus
*Assistant Examiner*—Jes F. Pascua
*Attorney, Agent, or Firm*—Wenderoth, Lind & Ponack

[57] ABSTRACT

A flexible intermediate bulk container includes at least two lifting loops which are integral extensions of a side wall structure and a base structure. The extensions are folded and joined to adjacent side wall panels such that each lifting loop connects with or is an integral part of two or three side wall panels and all fibers of the lifting loops have the same lifting height. The wall structure can have double layer walls such that each lifting loop is connected to or is integral with both layers and the ends of each lifting loop are displaced circumferentially relative to each other. Both wall structure and lifting loops can have integrally woven or stitched on reinforcing bands. The container can have an upper closure including a top lid, a filling spout and a wall structure with an open lower end.

10 Claims, 4 Drawing Sheets

FLEXIBLE CONTAINER COMPRISING SEVERAL LIFTING MEANS

BACKGROUND OF THE INVENTION

This invention relates to flexible intermediate bulk containers (FIBC) used in the storage and transport of bulk products in granular, powder or paste forms.

Such FIBCs having integral lifting means, i.e. the lifting means are extensions of the side wall structure. The total width of all lifting means constitutes at least 25 % of the FIBC circumference, and at least 50 % of the longitudinal fibers of the wall structure are directly employed when the FIBC is lifted.

Generally speaking FIBCs are manufactured from at least one piece of woven fabric, particularly woven poly-propylene or other suitable synthetic material and are required to carry loads of 500 or more with a considerable safety margin.

Several proposals for the construction of such FIBCs are known. Typical common features are:

a side wall structure made together from one or more panels of woven fabric stitched together to form a tube or from a piece of tubular fabric to thus eliminate side seams;

a base construction closing the lower side wall structure; open end of the FIBC lifting mean(s) at the upper end of the side wall structure capable of taking the load when the lifting mean(s) are engaged with suitable lifting mechanisms such as hooks or tines of a fork lift truck;

and frequently closing means at the upper end of the side wall structure in the form of a lid of flexible product, stitched to the upper circumference of the wall structure. The lid can be equipped with a filling spout of flexible material.

The lifting means can be separate lifting loops stitched on to the side wall structure or be formed by integral extensions of the side wall structure.

In GB Pat. No. 1,475,019 the combined width of two lifting loops corresponds to 50 % of the FIBC circumference, i.e. all longitudinal fibers of the wall structure are employed when it is lifted.

FIBCs in accordance with above patent have proved to be very successful for the storage and transport of numerous bulk products. A major reason for such success has been the simple construction and the high lifting capacity of such FIBC's. However, the use of such FIBCs have also had their restrictions, especially when applied in areas with restricted overhead clearance, e.g. loading in closed containers or railway wagons, as the total height of such FIBC when lifted is too large compared with the fill height of the contained product.

For FIBCs having four lifting loops sewn onto the wall structure, restricted overhead clearance does not constitute a problem.

FIBCs having the tunnel shaped lifting loops, sewn on or integral with the wall structure, are also known.

From GB Patent No. 1,549,448 a FIBC having two tunnel shaped lifting loops, which are sewn onto two adjacent sides of a wall structure employing only 50 % of the longitudinal fibers of the wall structure when the FIBC is lifted, is known.

Further it is known from U.S. Pat. No. 4,300,608 to use two lifting loops which are integral parts of two opposing sides of the wall structure, again only 50 % of the side wall structure circumference being employed when the FIBC is lifted. In this respect these two known arrangements are identical. The latter, however, has the advantage of upraised and opened lifting loops due to the inserts of the lifting loops, thus making engagement with suitable lifting mechanisms, especially the tines of a fork lift truck, easy. As the inserts are separate pieces, this solution will be more expensive.

EP Pat. No. 0,050,845 relates to a FIBC manufactured from two or four panels of woven fabric which, when stitched together, form a FIBC with a single or double layer base and four integral lifting loops. The lifting loops are direct extensions of the panels constituting the wall structure and their combined width corresponds to 50 % of the circumference of the FIBC. Thus, all longitudinal fibers are employed when the FIBC is lifted.

FIBCs according to above EP-patent permits handling in areas with restricted overhead clearance, but the lifting capacity is reduced due to hoop stress concentrations at the top center of each of the four wall panels. Another disadvantage of these FIBCs is the apparent distortion of the lifting loops, thus making direct engagement with normal lifting mechanisms difficult. For example, a fork lift truck driver will need a helper to engage the tines of the fork lift truck into the lifting loops, thus increasing the cost of every handling operation. Both disadvantages can to some extent be reduced by increasing the length of the lifting loops, but then the requirement for overhead clearance increases. This type of FIBC constitutes an obvious compromise and its use will therefore be restricted.

In the continued research and development relating to this type of FIBCs, i.e. FIBCs having low lifting heights and a plurality of integral lifting loops, the inventors tried to meet the needs for improved lifting capacity, reliability and ease of handling.

SUMMARY OF THE INVENTION

The main object of the present invention is to provide an improved FIBC with lifting loops, preferably two or four, which can easily be engaged by suitable lifiting mechanisms, especially the tines of a fork lift truck, and at the same time meet the requirements for easy handling in areas with restricted overhead clearance and having a high lifting capacity.

Another object is to reduce the difference between total height when lifted and the fill height of contained product to permit stacking in areas with restricted overhead clearance, thus increasing the transport capacity of closed vehicles and containers.

A further object is to permit filling of the FIBC while it hangs by its lifting loops only, e.g. hanging on the tines of a fork lift truck.

To meet the above objects the inventors had to find ways to reduce, or compensate for the influence of hoop stress concentrations at the top center of each of the four wall panels.

There are two reasons for build up of hoop stress:

a. The horizontal load component, viewed perpendicular to the wall panels, results in hoop stress, since each part of the load from each lifting loop is not at the center of the wall panel. Thus, the longer the lifting loops, the smaller is the angle and the smaller will be the hoop stress component.

b. A purely geometrical problem, due to the width of the lifting loop, which can be up to ¼ of the FIBC circumference. In a FIBC according to above EP patent the extension of one wall panel is split in two halves, each to form a lifting loop and half of an adjacent wall panel. The edge of a lifting loop reaching from the top center of a wall panel to the top center of an adjacent wall panel will then have a shorter lifting height than the other edge of the lifting loop, which reaches to and from the upper corner between the two wall panels. The inner edge of the lifting loop will therefore take the higher load when the FIBC is lifted by fork lift truck tines.

The inventors now found that if each half of a wall extension was rotated such that one edge would reach from the top center of one side wall panel to the corner of the same side wall panel and the other edge would reach from the same corner to the top center of the other adjacent side wall panel before stitching the corner seam of the wall structure, the lifting height of both edges of the lifting loop would be equalified. Not only are both edges of the lifting loop equalized; but all fibers therebetween are equalized and the lifting capacity of the modified FIBC increases. This implies that all fibers in the longitudinal direction of the lifting loop have substantially the same lifting height in the unstressed mode. Another surprising effect of the above modification of the basic construction of the FIBCs in accordance with the above EP patent is that the apparent distortion of the lifting loops disappears, making easy the direct engagement of the lifting loops by the tines of a fork lift truck.

However, the remaining hoop stress at the top center of each side wall panel was still considerable due to the loads in the lifting loops being off center and the lifting capacity of the FIBC was therefore limited. Increasing the length of the extensions of the wall structure forming the lifting loops would reduce the hoop stress, but caused an undersirable increase in the FIBC lifting height.

It is known in the art to close a FIBC at the top with a lid of woven flexible material stitched to the side wall structure along its upper circumference at the product fill level or above. Such lid can have a filling spout of flexible material in its center. After filling of the FIBC the filling spout is tried off, thus preventing product to from flowing out if the FIBC should topple.

The inventors now found that if they provided such a lid with a wall structure having an open lower end, placed it inside the FIBC with the wall structure of the lid extending downwards, a double wall structure was created in the upper part of the FIBC. This arrangement would then permit the outer wall extensions forming the lifting loops to start below the product fill height, without creating openings in the combined wall structure from which product inside the FIBC would leak. Thus the length of the lifting loops could be increased, hoop stress in the outer wall structure reduced and the lifting capacity of the FIBC could be increased without increasing its total lifting height.

The lid with its inner wall structure can be made of light and inexpensive product as its only functions is to keep the bulk product inside the FIBC.

The lid with its inner wall structure is fastened to the outer wall with suitable fastening means, e.g. stitching, glue, etc. The positioning of the lid is at the product fill height or above. The inner wall structure overlaps the outer wall structure with a suitable margin.

The fastening of the inner wall structure to the outer wall structure need only be strong enough to keep it in position until the FIBC is filled since the pressure from the contents thereafter will press the inner wall structure against the outer wall structure.

Preferably the lid is given a squarish shape with its corners protruding into the openings of the lifting loops, thus causing the lifting loops to open and stand erect thereby making engagement of suitable lifting mechanisms even easier.

If the cuts creating the outer wall extensions in two adjacent side panels are stopped approximately at the area of the top of the lifting loops, each pair of lifting loops will be transformed into "tunnels" forming two tunnel-shaped lifting loops.

Normally a uniform load distribution along the wall structure increases the lifting capacity. But the loop stress concentration at the top center of each side panel still caused problems on some of the prototypes. Instead of improving the load distribution the inventors therefore tried to relieve the area around the top center of the wall panels of lifting stress to avoid the negative effects of the hoop stress. This was obtained by strengthening sections of the wall fabric on each side of and at some distance from the center of each wall panel. The reinforced sections of the side walls continuing into and becoming parts of the lifting loops will then take a larger part of the lifting stress than the parts of the side wall and lifting loop fabric consisting of base fabric only. The top center areas of the wall panels are then relieved on both lifting and hoop stress and the lifting capacity of the FIBC is increased. Surprisingly the distance between the center of a side wall and the reinforced section of the wall fabric had no significant influence on the lifting capacity. Such reinforced sections of the base fabric can be achieved by either integrally woven reinforcing bands using conventional weaving techniques, e.g. by inserting two warp threads at the position of one, or by simply stitching reinforcing bands onto the base fabric.

FIBCs in accordance with the invention can be made in different ways.

A preferred embodiment is made from a single layer fabric which is split along the center from each side to a length corresponding to the height of a side panel plus approximately the desired length of the lifting loops, to construct a FIBC with four lifting loops, or plus approximately half the desired lifting loop length, to construct a FIBC with only two lifting loops. The part of the fabric which has not been slit is used to form the base and two opposing side wall panels.

Another arrangement is made from two identical pieces, each slit in half at approximately half of its full length. Again, the non-split layers form two opposing side wall panels. By rotating each of the slit lengths and stitching corner seams and seams connecting the two halves of the adjacent side panels, the same top as decribed above with two or four lifting loops, is formed, but with the lower end of the side wall structure being open.

Another preferred construction is particularly based on the use of a tube of circular woven fabric or from suitable panels of flexible fabric stitched together to give the required form. The tube can have reinforcing bands.

Along the upper edge of the tube, equidistant slits are made to form integral extensions of the wall structure. Each of the integral extensions are then stitched together in pairs forming integral lifting loops. To form lifting loops having constant lifting height across the width of the loops, the loops can either be sewn together at an angle making the inner edge of the lifting loop longer than the outer, or one of the extensions can be rotated half way around its axis before connecting it to its counterpart.

The construction especially suited for high lifting stresses comprises a side wall structure having an outer wall and an inner wall lying within and closely adjacent to the outer wall, a base closing a lower open end of the side wall structure, and a plurality of lifting loops at the upper end of the side wall structure. Each lifting loop has a first end that is connected to or integral with the outer wall and a second end that is connected to or integral with the inner wall.

This embodiment of the invention thus constitutes what can be considered a double-walled FIBC closed by a base structure common to the two walls. The first and second ends of each lifting loop may be connected to or integral with the respective walls in substantially the same circumferential region of the wall structure. Preferably, however, the first and second ends of each lifting loop are displaced one from the other around the circumference of the FIBC, as overall stress distribution thereby is improved.In a particularly preferred arrangement, four lifting loops are provided, and the circumferential spacing between the two ends of each lifting loop is substantially equal to the circumferential spacing between adjacent ends of adjacent lifting loops.

BRIEF DESCRIPTION OF THE DRAWINGS

In order that the invention may be better understood, the manufacture of various embodiments of FIBCs according to the invention will be described in more detail, by way of example only, with reference to the accompanying drawings.

DETAILED DESCRIPTION OF THE INVENTION

Figure 1:
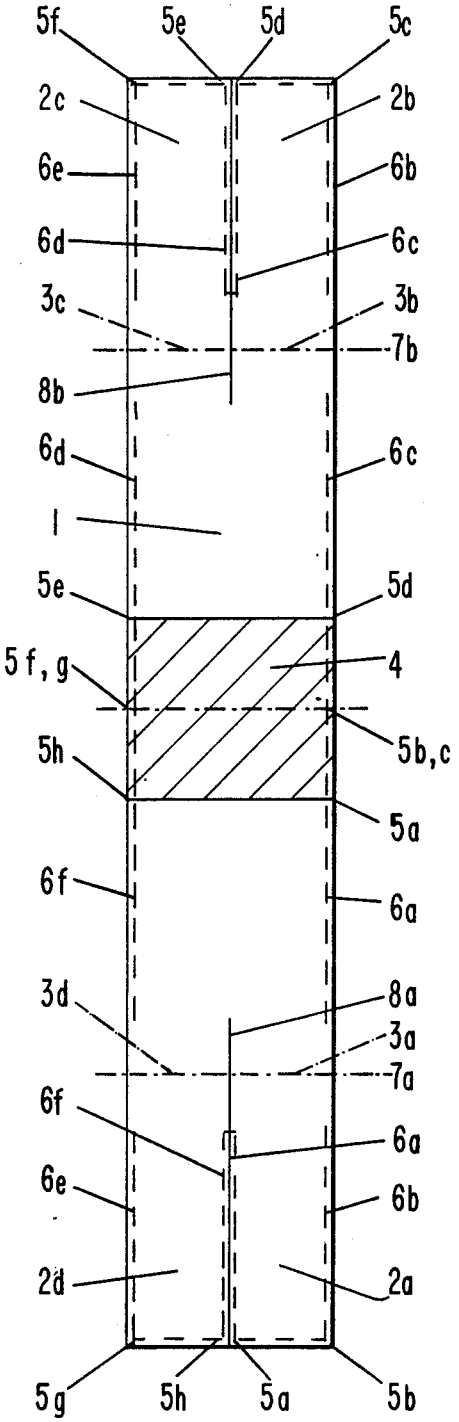
FIG. 1 is a schematic view showing a blank in the form of a length of flat woven fabric which has been slit at both ends thereof along the center line thereof before it is folded and stitched together to form a FIBC with four lifting loops and a single layer base.

FIG. 1 shows a length of flat woven fabric 1 which has been slit along the middle from both ends to form four integral extensions 2*a*, 2*b*, 2*c* and 2*d*, each representing a lifting loop 3 (3*a*, 3*b*, 3*c* and 3*d*) and one half of two opposing side panels, the hatched center area 4 of the fabric represents the base of the FIBC.

The integral extensions 2*a* and 2*b* are now folded and rotated and corners 5*a*, 5*b*, 5*c* and 5*d* are connected with corresponding points 5*a*, 5*b*, 5*c* and 5*d* along one edge of base fabric and stitched together along a common seam 6*b* thereby forming one side panel. The next step is to fold the integral extensions 2*c* and 2*d* and connect corners 5*e*, 5*f*, 5*g* and 5*h* with corresponding points along the other edge of the base fabric and stitch up a common seam 6*e* to form another sidepanel opposite to the first. The base is then closed by sewing the base seams from 5*a* to 5*d* and 5*e* to 5*h*. The last is to close the wall structure by stitching up corner seams 6*a*, 6*c*, 6*d* and 6*f*.

The result is a FIBC with four integral lifting loops and a wall structure with four side wall panels closed at its lower end with a single layer fabric.

To form a FIBC with only two lifting loops one has to reduce the length of the cuts 8*a* and 8*b* to the vicinity of the top of the lifting loops indicated by respective center lines 7*a* and 7*b*.

The FIBC can also be constructed with a double layer base by extending the integral extensions 2*a*–2*d*. The length of the extensions shall correspond to half the width of the base. The double base is formed by joining the extensions either inside or outside the FIBC.

Figure 3:
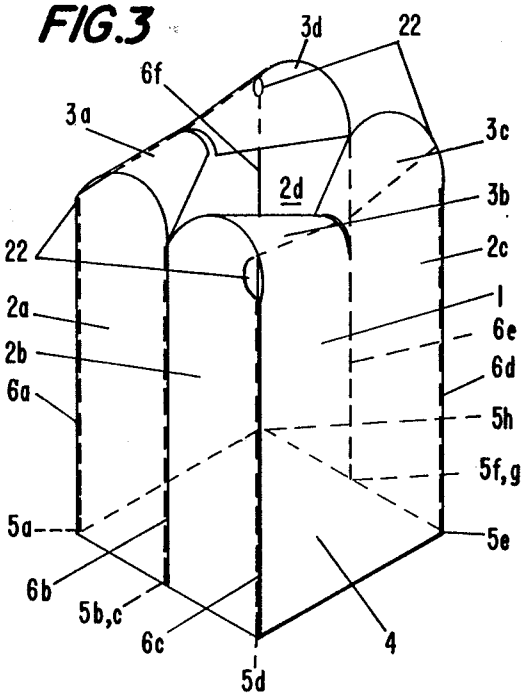
FIG. 3 is a perspective view of the FIBC with four lifting loops made form the blank of FIG. 1.

The FIBC constructed from the single length of fabric in FIG. 1, shown in a perspective view in FIG. 3, has four, alternatively two, lifting loops which are easily engaged by the tines of a fork lift truck, has reduced lifting height and can be filled while the supported by its lifting loops only.

Figure 2:
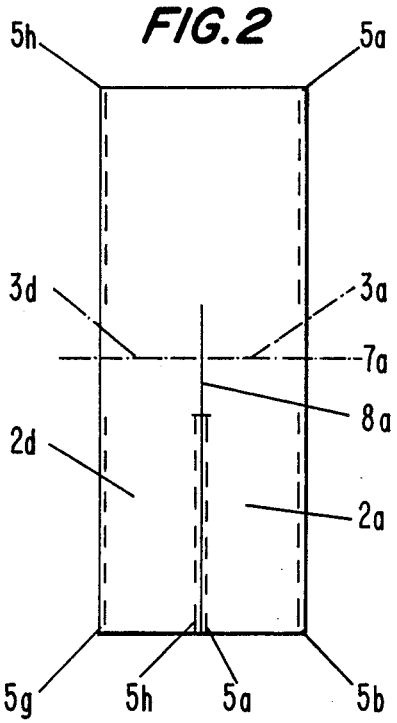
FIG. 2 is a schematic view showing a blank in the form of a length of flat woven fabric which has been slit at one end along its center line before it, together with an identical blank, is folded and stitched together to form the top of a FIBC with two tunnel shaped lifting loops and a wall structure with an open bottom end.

The FIBC can also be made rom two identicals lengths of flat woven fabric as shown in FIG. 2 where the cut 8*a* has been reduced to make a FIBC with only two lifting loops. Each length of fabric constitutes one full side wall panel and two halves of the adjacent side wall panels when formed in the same manner as described above with regard to FIG. 1, but this FIBC will be open at the lower end of wall structure. The FIBC may then be completed by adding to it a suitable base structure. In its simplest form the base can take the form of a separate cut piece of fabric simply stitched to the lower ends of the wall structure.

Figure 4:
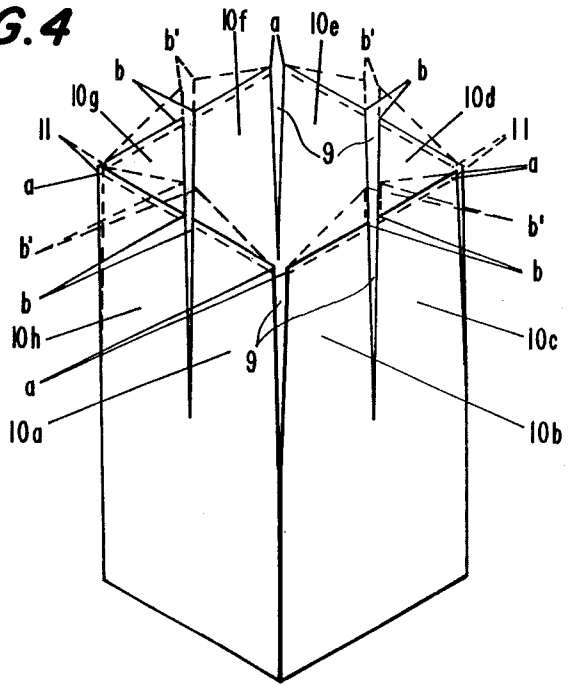
FIG. 4 is a perspective view of a blank in the form of a length of tubular woven fabric which has been slit at the top to form eight integral extensions of the wall structure thereof before the eight extensions are stitched together to form the top of a FIBC with four lifting loops.

The cut length of circular woven fabric shown in FIG. 4 has been slit at the top at eight equidistant places around the circumference. The cuts 9 forms eight integral extensions 10*a*–10*h* each having upper end corners a and b.

By folding and rotating the extensions in pairs e.g. 10*a* and 10*b*, matching corner a with corner b and corner b with corner a of adjacent extensions, and joining them along seams 11, four lifting loops, identical to 3*a*–3*d* of FIG. 3 except for their joining seam, are formed.

The construction thus achieved comprises a side wall structure with four lifting loops that are integral extensions of the side wall structure and have joining seams at their top ends and is identical to the construction shown in FIG. 3 except there are no side seams (6a–6f) and the wall structure is open at its lower end.

As indicated in FIG., upper ends of the integral extensions 10a–10h can be cut at an angle to the principal axes of the respective lifting loops. By folding the extensions in pairs and matching corner a with corner a and corner b' with corner b' of adjacent extensions, e.g. 10a and 10b, and joining them along seams 11, four lifting loops are formed, Due to the angle of the top cut of each extensions both edges of the lifting loops and all fibers therebetween are equalized to be of the same lifting height.

It is obvious that the same affect can be obtained without cutting the extensions 10a–10h at an angle as long as each seam 11 forms an angle with the principle axis of the respective lifting loop. In that case the two joined extensions will overlap by such angle.

The cut blank of FIG. 4 is formed from a tube of circular woven fabric. It is of course possible to make such blanks from one or more pieces of flat woven fabric by joining two or more edges with seams to thus create a tube.

The cut blank of FIG. 4 have been illustrated with all cuts being of equal length thus creating an FIBC top with four lifting loops. However, by reducing the central cut on any two opposing side panels to approximately half their length, a FIBC top with only two lifting loops is formed.

Due to absence of tensile hoop stress at the four upper corners of the wall structure, the length of these cuts can be reduced while maintaining the lifting capacity of the construction.

The forming of the lifting loops has been illustrated using the preferred arrangement of the integral extensions having equal lengths. However, it is within the scope of the invention to have the extensions be of different lengths as long as the sum of each pair of extensions which are joined together is the same. It is also possible to construct the top of the FIBC with only two opposing side panels being integral extensions and connecting the ends of these extensions to adjacent side panels of the wall structure, somewhere between its upper and lower ends. If joined at the lower end, the wall structure will comprise two side panels with double layers and two side wall panels with a single layer. Elongating the extensions still further, they can be joined together below the lower end of the wall structure and even form a single layer base construction.

Figure 5:
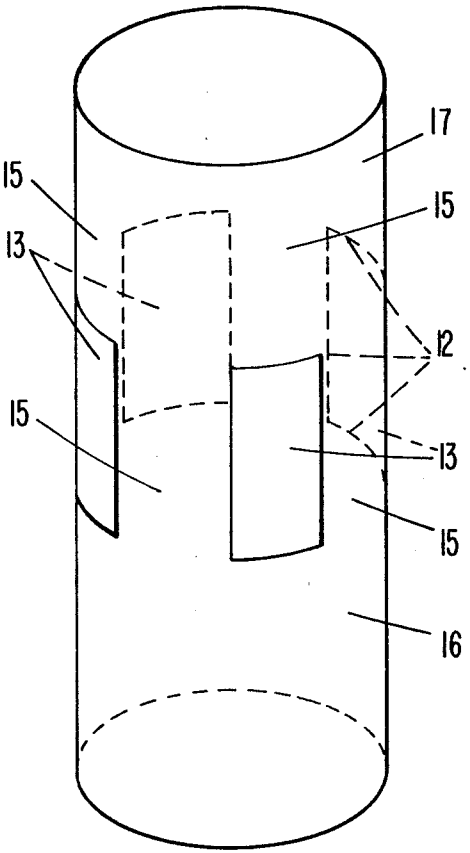
FIG. 5 is a perspective view of a blank in the form of a length of tubular woven fabric which has been cut at the central region thereof along cutting lines.

FIG. 5 shows a blank in the form of a length of tubular woven fabric. Optionally the fabric can have reinforcing bands (not shown) woven integrally with or connected to the base fabric extending parallel to the axis of the tube. To form lifting loops the tube is cut longitudinally in the central region at equidistant circumferential positions and between adjacent reinforcing bands when such bands are used. One may also cut four panels of the base fabric along three edges 12 to form flaps 13, which are folded along their uncut edge and joined to the uncut parts of the tube along seams 14 (FIG. 6).

Figure 6:
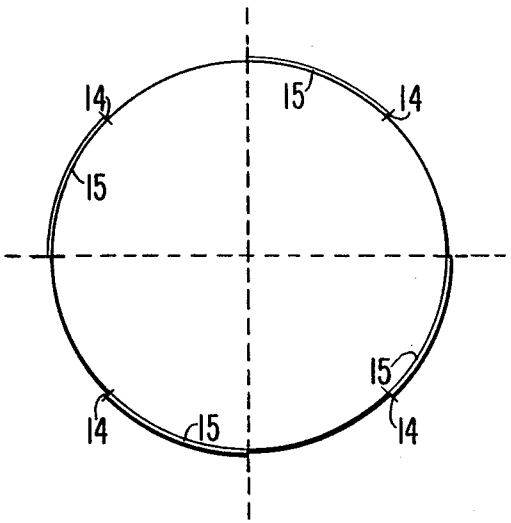
FIG. 6 is a cross section at the central region of FIG. 5 after panels thereof have been folded and stitched onto lifting loops.

FIG. 6 shows a cross-section of the central region of the tube after folding and joining of the flaps, the flaps having the same width as the uncut parts of the tube, which eventually wil become lifting loops 15. The flaps can for example by cut wider than the lifting loops and be wrapped several times around the lifting loops before being joined to the lifting loops by suitable means such as glue, seams, etc., the result being narrower lifting loops. The reinforcing bands can have the same width or be narrower than the width of the lifting loops.

Figure 7:
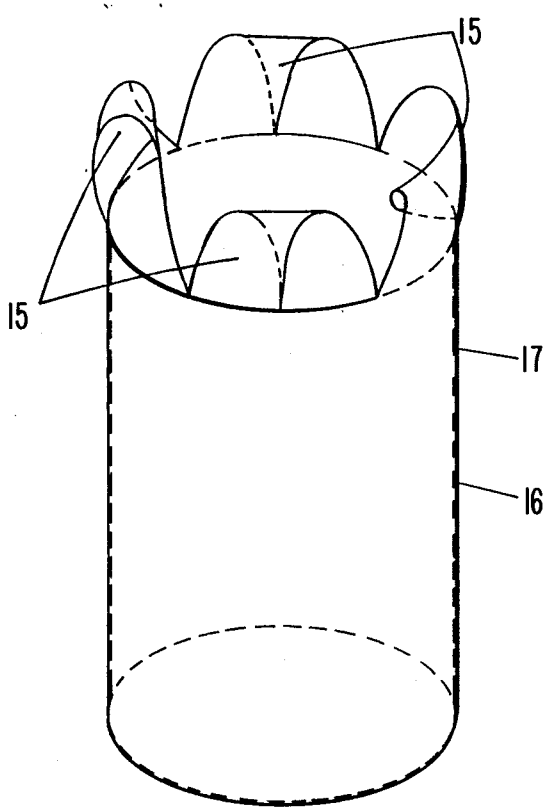
FIG. 7 is a perspective view of a FIBC with four lifting loops with a double wall structure and which is open at its lower end.

The next step is to take hold of one end of the length of tubular fabric and to turn this inside out and draw it into and through the remainder of the fabric to form a double-walled tube, thus effectively folding the fabric around the center parts of the uncut sections that will form the lifting loops 15. The tube then constitutes a side wall structure having an inner wall 16 and an outer wall 17. Either during the folding operation or after, the inner wall is rotated through, e.g., 45° relative to the outer wall to arrive at the structure shown in FIG. 7. It will be seen that this action displaces the first and second ends of each lifting loop relative to each other by 45° around the circumference of the wall structure, and that circumferential spacing between adjacent ends of adjacent lifting loops is also 45° . The amount of this rotation may be varied, but must be at a minimum equivalent to the width of the lifting loops to also impart a 180° rotation of each loop to equalize the lifting height of both edges of each lifting loop and all fibers. Having achieved the structure shown in FIG. 7, the FIBC may then be finished by adding to it a suitable base structure and possibly a suitable top structure e.g. of the type shown in FIG. 8. The base may be formed by extensions of the fabric of either the inner wall, the outer wall or both walls, the extensions being suitable cut, folded and stitched to form a base of the required shape or by simply stitching a separate cut piece of fabric to the lower ends of the two walls.

In the preferred arrangement, the tube of FIG. 5 is folded and rotated in such a way that the folded flaps form a protective layer of fabric inside the lifting loops protecting the loadcarrying fibers of the lifting loops from wear in accordance with EP patent application Ser. No. 84102.195,9. According to such patent application the flaps 13 can also be used to form protective sleeves for the lifting loops.

FIBCs according to the invention may be open or closed by a cut piece of fabric stitched around the upper part of the side wall structure, such piece of fabric having any suitable opening through which the FIBC can be filled.

Figure 8:
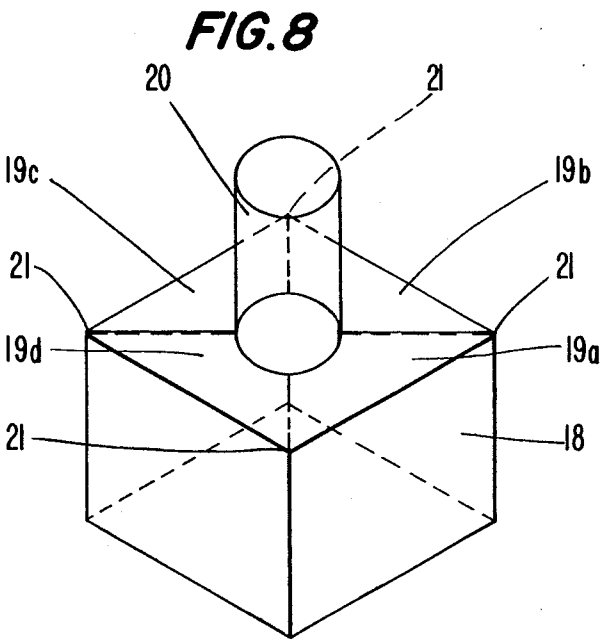
FIG. 8 a perspective view of a top closure with a filling spout and a wall structure which is open at its lower end.

However, as it is an object of the invention to reduce the height of the lifting loops above the product fill height, a better arrangement is to fit the top fabric with a wall structure of approximately the same girth diameter as the FIBC and which has an open lower end. The top structure shown in FIG. 8 is made from a length of tubular woven fabric 18 which at the top has been cut to form four flaps (19a–19d) which are joined together along seams or by other suitable means to form a single layer top of squarish form. In the center is fitted a tubular piece of fabric 20 which will serve as a filling chute and which can be closed by tying off with string, etc. It will be appreciated that this top structure also can be stitched together from several panels of fabric giving it the same principal shape as that of FIG. 8.

The top structure of FIG. 8 can be placed inside any FIBC according to the invention, and any other FIBC when it is appropriate to close the upper end of the side wall structure, with the lower open end of the top structure below the deepest cut in the side wall structure of the FIBC. This effectively seals off any cut opening of the arrangement through which product otherwise can flow when the fill height of the product in the FIBC is raised to its maximum, i.e. above the deepest cut opening in the wall structure.

In the preferred arrangement the top structure of FIG. 8 is placed inside the FIBC shown in FIG. 3 in such a way that corners 21 of the top structure fit within openings 22 of the lifting loops 3*a*–3*d* thus pressing them open to make engagement of lifting mechanisms even easier.

The FIBCs shown in the drawings in accordance with the invention are basically of preferred form and arrangement. However, it wil be understood that FIBCs may be made in other ways, e.g. a FIBC with double walls, manufactured from a single length of tubular woven fabric, may also be constructed from two similar sections of tubular fabric, each having been cut at one end to form upstanding integral extensions. One such length of fabric is then drawn into the other length of fabric with a minimum displacement corresponding to the width of the extensions, e.g. 45° between the two lengths. The free end of each upstanding extension of the resulting outer wall structure is then sewn to the free end of the adjacent upstanding extension of inner wall structure. In other arrangements the inner and outer wall structures may be formed from suitable panels of fabric stitched together to give the required construction.

The examples described are of FIBCs having two or dour lifting loops, but it will be appreciated that the invention can be applied to a FIBC having any even number of loops, and that when formed from a fabric having interwoven or stitched-on reinforcing bands, such bands will be located according to the number of the loops. Other modifications will be apparent to those skilled in the art.

The FIBC of the invention can be equipped with protective sleeve (s) as described in EP-patent application Ser. No. 84102.195,9.

By the present invention therein obtained a FIBC with multiple lifting loops having a high lifting capacity, since at least fifty per cent of all vertical fibers in the wall structure are employed to carry the load. The lifting loops of the FIBC have a low lifting height which has been equalized over the full width and can easily be engaged by normal lifting mechanisms, e.g. the tines of a fork lift truck, thus avoiding the need for special or complicated lifting devices. The FIBC can be filled while hanging by its lifting loops only, which together with a square base construction contributes to its square shape.

An essential advantage which is obtained by the present invention is that the product in the FIBC can have a fill height above the actual wall structure. This is made possible with the insertion of a top structure, comprising a top lid with a filling spout and a wall structure with an open lower end, inside the top of the FIBC. The distance between fill height and the top of the lifting loops is thereby considerably reduced. Such FIBCs can be handled in areas with very small overhead clearance, and when stacked in transport means, such as closed containers, railway wagons, etc., very little space is left unused.

The top structure helps the FIBC retain its square shape when stacked for storage and transport.

With the present inventin one is free to employ a multitude of base constructions, for instance base constructions in accordance with GB Pat. No. 1,580,576 and EP patent application Ser. No. 84110,404,5.

If required, any of the base constructions may be equipped with any suitable spout or other discharge arrangement.

We claim:

1. In a flexible intermediate bulk container including a side wall structure formed of at least one piece of flexible woven material, a base structure at the bottom of said side wall structure, and at least two lifting loops formed of integral extensions of upper portions of said side wall structure, said lifting loops having a total combined width equal to at least 25% of the circumference of said side wall structure, the improvement wherein:

said side wall structure includes plural side wall panels;

each said side wall panel includes at least one said integral extension; and each said lifting loop is formed by folding and joining respective said integral extensions of adjacent said side wall panels at an angle to the principle axis of said lifting loop, such that each said lifting loop is composed of material of said adjacent side wall panels, and opposite edges of each said lifting loop and all fibers of said material therebetween have substantially the same lifting height in an unstressed mode.

2. The improvement claimed in claim 1, wherein said side wall structure includes four said side wall panels, and each said side wall panel includes two said integral extensions.

3. The improvement claimed in claim 2, wherein said two integral extensions of each said side wall are separated by a longitudinal slit formed in said side wall panel, and each said lifting loop is formed of half of the material of each of said adjacent side wall panels.

4. The improvement claimed in claim 1, wherein ends of said integral extensions extend at said angle to thereby define a shorter edge and a longer edge of each said integral extension, and said integral extensions of said adjacent side wall panels are connected shorter edges-to-shorter edges and longer edges-to-longer edges.

5. The improvement claimed in claim 1, wherein each said side wall panel includes at least one reinforcing band extending along each said lifting loop of each said integral extension.

6. The improvement claimed in claim 5, wherein each said side wall panel includes two said integral extensions forming respective said lifting loops.

7. The improvement claimed in claim 5, wherein said flexible woven material includes a base fabric, and said reinforcing band is integrally woven with said base fabric.

8. The improvement claimed in claim 5, wherein said flexible woven material includes a base fabric, and said reinforcing band is attached to said base fabric.

9. The improvement claimed in claim 1, further comprising a top structure positioned with said container, said top structure including a top lid having means for filling bulk material therethrough into said container, and a wall structure of approximately the same outer dimensions as said side wall structure of said container, said wall structure extending downwardly from said top lid and having an open lower end positioned below the lowest opening in said side wall structure of said container.

10. The improvement claimed in claim 9, wherein said filling means comprises a filling spout.

* * * * *